United States Patent [19]

Malik

[11] Patent Number: 4,458,867

[45] Date of Patent: Jul. 10, 1984

[54] WIRE RACK BAG HOLDING DEVICE

[76] Inventor: James J. Malik, 6618 Bennington Dr., Parma Heights, Ohio 44130

[21] Appl. No.: 476,070

[22] Filed: Mar. 17, 1983

[51] Int. Cl.[3] ..... A63B 55/04

[52] U.S. Cl. ..... 248/97; 248/99

[58] Field of Search ..... 248/95, 97, 99, 100, 248/101, 175; 141/390; 53/390; 220/404

[56] References Cited

U.S. PATENT DOCUMENTS

| | | | |
|---|---|---|---|
| 447,686 | 3/1891 | Holladay | 248/100 |
| 812,157 | 2/1906 | Thompson | 248/97 |
| 3,614,040 | 10/1971 | Martinez | 248/175 |
| 4,332,361 | 6/1982 | McClellan | 248/95 |

FOREIGN PATENT DOCUMENTS

| | | | |
|---|---|---|---|
| 1049490 | 11/1966 | United Kingdom | 248/99 |

*Primary Examiner*—J. Franklin Foss
*Attorney, Agent, or Firm*—Alfred D. Lobo

[57] ABSTRACT

A wire rack for holding a plastic bag open so that it can be filled, is constructed from wire stock, essentially without any welds. The plastic bag has integral handle loops which are held apart in the rack. Essential components of the wire rack are left and right swing panels each formed from a single length of wire stock; a spacer frame comprising plural parallel wire members having wrap-around-ends, wrapped around the upper portions of each panel; and, a laminar base support means connecting the panels, upon which base the bag rests. Each swing panel includes a tab-shaped horizontal upper portion to engage a handle loop of the plastic bag so as to hold it open. Essential freedom from welds dispenses with problems related to failure of the welds. In one particularly preferred embodiment, the wire rack may be collapsed for shipping. It is assembled simply by swinging the panels into mirror-image spaced-apart relationship with each other, and connecting the lower portions of the panels with an impact resistant synthetic resinous support base, preferably by fastener means the heads of which are recessed in the base.

6 Claims, 6 Drawing Figures

WIRE RACK BAG HOLDING DEVICE

BACKGROUND OF THE INVENTION

Wire racks have attained a high degree of commercial acceptance because of the relative ease with which they may be fabricated, the low cost of wire stock and the short time required to fabricate them. Such racks are particularly popular for relatively small and light objects which must be displayed prominently; and to save storage space, such racks are collapsible as shown in my U.S. Pat. No. 3,726,415. Such racks are not generally regarded favorably for heavy duty applications, referred to as such because in such applications, these racks are subjected to rough treatment if not outright abuse. Treated roughly, the welded joints of the racks, typically resistance welded, are prone to failure.

Racks used to hold grocery bags open while they are filled belong in the heavy duty category. It is common experience that groceries including canned goods and the like are loaded into a grocery bag with the emphasis on haste rather than care. As a result, a device such as is shown in U.S. Pat. No. 4,062,170 to hold a plastic bag with integral handle loops open, by inserting tab-shaped protrusion into the loops, was initially made of heavy steel sheet metal. Not surprisingly, the cost of fabricating such devices was discouragingly high considering the economics of the circumstances surrounding their use, and much energy and time was devoted to finding a more economical way.

It eventually became evident that economies in fabrication could be effected if the rack was made of wire for the most part, and such a rack has been constructed as will be described hereinbelow, and placed in service, with unexpectedly discouraging results. The racks broke at the welds. The plastic bags were prone to be ensnared by indentations in the base, or on protruding heads of machine screws used to secure the base to a counter top, and even at the edges of the base. By no means of least importance was the waste of space in cartons in which the racks were shipped.

As is well known, the cost of welding in the fabrication of any welded article is a substantial cost, and it is in the interest of economy to use the least expensive method of welding which will provide the desired strength. As wire stock from which an adequately sturdy rack is made is typically about 0.25" (inch) in diameter, or less, resistance welding is the most practical method of fabrication. Since such welds were less than reliable in service, arc welding the joints was tested, but the arc welded joints were still unsatisfactory and the cost of the racks became prohibitive. Since mechanical fastening means were equally uneconomical, it appeared that the discouraging economics of fabrication would have to be tolerated.

Since the reality of the marketplace dictates that the cost of supplying suitable racks, for use in holding plastic bags open, is to be met from the profits of selling the bags, it is essential that the cost of the racks be minimized.

The wire rack of my invention has succeeded in minimizing cost yet improving performance.

SUMMARY OF THE INVENTION

It has been discovered that the cause of the failure of joints in wire racks used to hold a plastic bag open, so it may be loaded, stemmed from the particular angulation of critical support struts, and the manner in which the joints were welded, particularly if the joints were made by resistance welding.

It is therefore a general object of this invention to provide a wire rack for holding a plasic bag open, which wire rack is fabricated without welding the critical load-bearing joints. Such a rack is fabricated with 'wrap-around' ends, so called because an end of wire stock is wrapped around a portion of wire stock. Though, in general, the wrap-around end may be slidable on the portion of wire stock, the construction of the rack of this invention imbues the wrap-around joint with greater strength and reliability than that obtained with a resistance welded joint, and at lower cost.

It is a specific object of this invention to provide a wire rack for the purpose of holding a plastic bag in an article-loading position, wherein the only structural component of the rack not formed from wire is the laminar base on which the bag rests while it is being loaded; and all essential load-bearing components formed from wire are so formed without welding.

It is also a specific object of this invention to provide a wire rack for the purpose stated, which rack is collapsible for shipping by reason of having swingable left and right panels each of which is formed from a single piece of wire, one end of which is in wrap-around engagement with a vertical support portion of the panel so as to permit its swingable movement around the vertical axis through said vertical support, through an arc of substantially 360°.

It is still another specific object of this invention to provide a wire rack which may be shipped with essentially no wasted space to the point where it is to be assembled; and the rack may then be assembled simply by connecting a laminar base of rigid synthetic resinous material between horizontal lower portions of the swing panels, by conventional fastening means, thus providing a smooth surface on which the bag is supported without danger of being cut or torn.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

Figure 1:
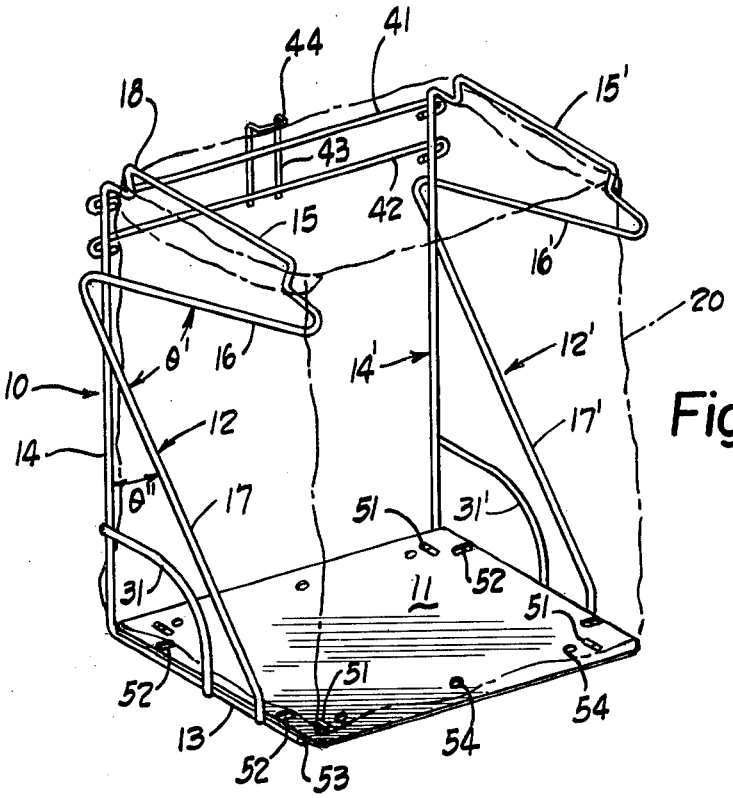
FIG. 1 is a perspective view of a prior art wire rack with resistance welded joints showing a plastic bag (in phantom outline), held open to be filled, by means of integral handle loops of the bag.

A prior art wire rack specifically constructed to hold a plastic bag (shown in phantom outline) open while it is loaded, is schematically illustrated in FIG. 1, the rack being generally indicated by the reference numeral 10, and the bag by reference numeral 20.

Individual bag structures, suitable for use in the practice of this invention, include those described in U.S. Pat. No. 3,180,557, and in German Gebrauchsmuster No. 1,844,267, inter alia, the disclosures of which are incorporated by reference as if fully set forth herein. Such plastic bags are desirably side gusseted, and may be formed from a gusseted flattened tube of thermoplastic material such as polyethylene. The gusseted flattened tube is heat sealed and severed along lengths of the tube which correspond to the height of the bag. One heat sealed and severed end is cut out in a generally U-shaped configuration intermediate the gusseted areas therein, forming an open bag mouth with loop handles on opposite sides thereof. These plastic bags are commonly used at present, details of their structure are well known, and need not be described herein nor illustrated in greater detail for the purposes at hand.

The rack comprises a laminar sheet 11 of metal, preferably steel, which provides a supporting base upon which the bag 20 rests as it is filled. On each side of the base 11 is provided a left wire frame and a right wire frame 12 and 12' respectively, to support the bag as it is loaded. Despite the seemingly undemanding strength requirements for a wire rack which fulfils the simple requirement of keeping the bag open while it is loaded, the surprising fact is that the wire rack must be exceedingly strong if it is to have the life expectancy demanded of it.

The left wire frame 12 consists essentially of a single length of wire which is bent so as to provide several portions, all in the same plane, each portion having a particular part in providing desirable strength to the frame. Such desirable strength may be described as optimum rigidity in the vertical plane such that a vertical load at the mid-point of the frame, at the top thereof, will produce a minimum deflection or flexure of the frame.

The wire frame 12 includes a lower horizontal portion 13, a vertical support 14, a tab-shaped horizontal upper portion 15, an upper angulated strut 16, and a lower angulated strut 17 terminating in contact with lower portion 13, and the end of 17 welded to the outer surface of 13, surfaces of the rack adjacent the bag being referred to as inner surfaces. Portions 16 and 17 define a V-shape with an included angle $\theta'$ and near the apex of the angle, the portions 16 and 17 lie in contact with the outer surface of vertical support 14. The points of contact are resistance welded, as is the point of contact between the lower end of strut 17 and the horizontal portion 13.

The tab-shaped upper horizontal portion 15 is so formed as to provide a horizontal protrusion 18 extending from one end of the tab-shaped portion which functions to secure a handle of the plastic bag 20; and, oppositely disposed relative to protrusion 18, an edge 19.

The repetitive loading of a multiplicity of bags, removing the loaded bags, and repeated impacts of cans and other heavy objects against the wire frames during loading, serve to induce severe strain in the welded joints. To provide additional strength to the wire frame 12, an L-shaped brace 31 is resistance-welded near its ends to the vertical support 14 and to the horizontal lower portion 13, to the outer surfaces thereof. Brace 31 also serves as a side keeper-rail to keep heavy articles from protruding from the wire frame, distending the bag, and causing such distended portion of the bag to be lodged in the vertex formed by support 14 and strut 17, forming angle $\theta''$ when the bag is lifted out of the rack. It was eventually realized that the acute angulation of the struts 16 and 17 was instrumental in contributing to the failure of the welds of the struts to the vertical support 14.

The right wire frame 12' is constructed in a manner analogous to that described hereinabove for wire frame 12, and is oppositely disposed parallel to, and in mirror-image relationship therewith, at a distance corresponding to slightly more than the width of a loaded bag. This wire frame 12' includes a horizontal lower portion 13', a vertical support 14', a tab-shaped horizontal upper portion 15', an upper angulated strut 16', a lower angulated strut 17' and a brace 31', the corresponding angles being the same.

The wire frames 12 and 12' are fixedly held in parallel spaced apart relationship by a spacer frame indicated generally by reference numeral 40 which comprises plural parallel vertically-spaced-apart spacer wires 41 and 42 of equal length, each having U-shaped terminal ends bent in the same planes, which ends are in contact with, and resistance welded to, the upper portion of vertical supports 14 and 14', so as to provide multiple weldment points for strength. A vertical keeper 43 having a horizontal forwardly protruding tab portion 44 is welded to the spacer wires 41 and 42 to stiffen them and to provide support for unopened bags stored on the spacer frame 40.

The laminar base 11 is provided with a pair of aligned indents 51 near the front and rear periphery of the base, and a pair of aligned indents 52 near the sides of the base. The indents protrude downward from the upper surface of the base, and the protruding portions are so shaped as to cradle a wire therebetween, to facilitate the resistance welding of the wire to the base. Thus, at the sides, the base is welded to the upper surfaces of the horizontal lower portions 13 and 13'; and at the front and rear, the base is welded to stiffening wires 53 (only the front wire is shown) extending the length of the base. The result is that the base 11 is welded at eight points to a rectangular frame of wire.

In addition, the laminar base is provided with plural through-passages 54 through which the base is fastened to a counter-top or other support surface upon which the bags 20 are to be loaded. Typically, round-head, or hexagonal head, or Allen head machine screws are used. The slight projections of the heads above the surface of the base contact the plastic bag and tend to nick and damage the plastic film sufficiently to allow a fissure to propagate, thus tearing the bag. Providing adequately indented wells in which the heads of the fastening means may be countersunk, requires an additional fabricating operation and is uneconomical.

Thus, despite what appears to be a highly adequate construction for a wire rack to perform a relatively simple function, it was found that the prior art wire racks currently in use are highly susceptible to failure of the welds. It was discovered that the failures at the welds near the V-shaped portion between struts 16 and 17 were due to inadequate vertical support at the front of the frame, which is related to the acute angulation, referred to hereinabove, of the struts 16 and 17. In addition, the base contributed to an unacceptably large number of failures of the plastic bags, despite providing smoothly polished round-head machine screws.

The structural inadequacy of the prior art wire rack affects its performance. Its welded rigid framework affects the cost of shipment of the wire racks, because of the wasted space in cartons in which the racks are packed. Both the problems were solved by the wire rack of my invention which does not require any welds to provide critical structural components with acceptable strength.

Figure 2:
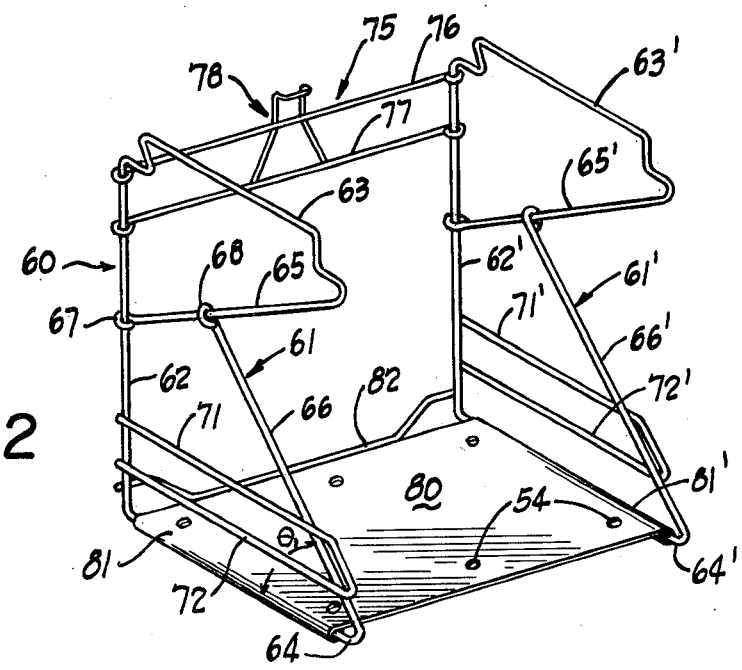
FIG. 2 is a perspective view of one embodiment of the wire rack of this invention which is not collapsible.

Referring now to FIG. 2 there is shown a wire rack referred to generally by reference numeral 60 comprising left and right swing panels 61 and 61' respectively. The swing panels are so termed because they are pivotable through an arc of substantially 360° as will be described hereinbelow. Each swing panel is formed from a single continuous length of wire stock having a diameter in the range from about 0.1875" to about 0.375" and most preferably about 0.25" in diameter. This wire is bent in a suitable jig, as is well known in the art, to provide a vertical support 62, a tab-shaped horizontal upper portion 63 having the same configuration as the tab-shaped portion 18 in FIG. 1, a horizontal lower portion 64, an upper angulated support strut 65, and a lower angulated support strut 66, the ends of the wire terminating in "wrap-around-ends" 67 and 68 which are tightly wrapped around vertical support 62 and angulated support 65, respectively.

The "wrap-around-end" is so termed because it is formed by clinching the end of a wire around another wire, as is known in the art. Because of the particular configuration of the swing panel in its planar configuration, with the angle $\theta_1$ between struts 64 and 66 being greater than 45° at least insofar as the initial portion of the strut 66 forming the angle with strut 64 is concerned, the wrap-around-end provides strong attachment to the wire around which it is wrapped, fixing it thereto without welding, yet providing greater strength than a resistance weld at the joint. Moreover, the angulation of the strut 66 in this surprisingly effective construction provides a support for even a large vertical load or force exerted upon the tab-shaped portion 63, so that there is essentially no visible flexure even with a load of 100 pounds. The critical factor in providing the strength is the angulation and wrap-around engagement of strut 66 intermediate strut 65. This forms a generally triangular upper sub-frame comprising member 63, 65 and the upper portion of vertical support 62; and, a quadrilateral lower sub-frame comprising member 64 and 66, and portions of support 62 and strut 65, this portion of strut 65 being common to both the triangle and quadrilateral.

To prevent shaped objects, particularly heavy ones, from being lodged in the quadrilateral formed by wire portions 62, 65, 66 and 64, it is generally preferred to provide a pair of parallel vertically-spaced apart side keeper-rails 71 and 72, which, because they are not subject to great strain, may be resistance welded to the outer surfaces of the wires 62 and 66. The side keeper-rails are conveniently formed from a single length of wire stock bent in a generally U-shape as shown.

The swing panel 61' is constructed in an analogous manner as that described hereinabove for panel 61, and includes a vertical support 62', a tab-shaped horizontal upper portion 63', angulated struts 65' and 66', and a lower horizontal portion 64', optionally provided with side keeper-rails 71' and 72'.

Figure 3:
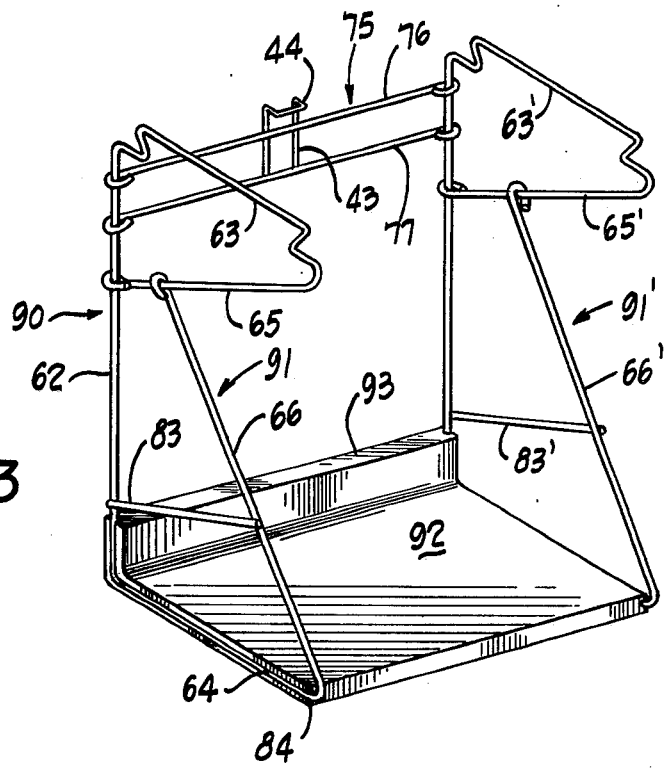
FIG. 3 is a perspective view of another embodiment of the wire rack of this invention which is collapsible for shipping and assembly at the site where it is to be used.
Figure 4:
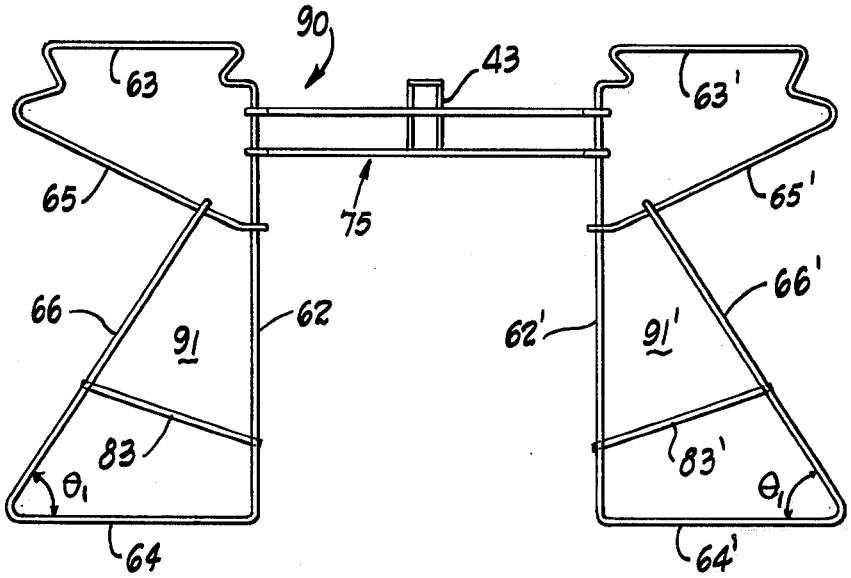
FIG. 4 is a plan view schematically illustrating the wire components of the rack illustrated in FIG. 3, with its swing panels in an open generally planar configuration.
Figure 5:
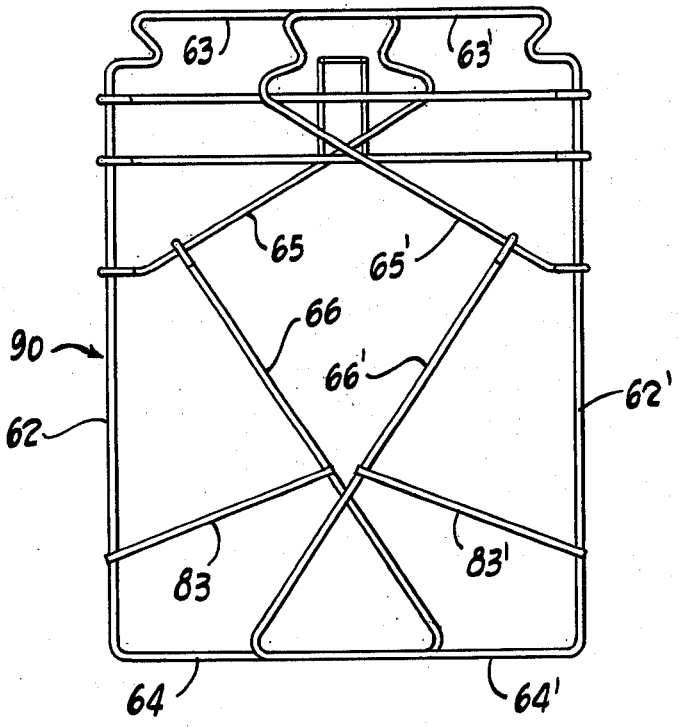
FIG. 5 is a plan view schematically illustrating the wire components of the rack illustrated in FIG. 3, with its swing panels in a closed or folded but still generally planar configuration.
Figure 6:
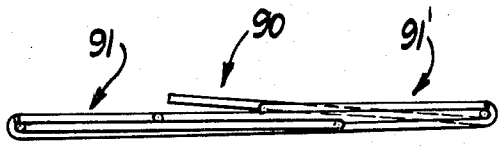
FIG. 6 is an end elevation view of the folded rack illustrated in FIG. 5 showing that there is essentially no wasted space in this configuration in which the rack is shipped.

The swing panels 61 and 61' are held in spaced apart relationship by a spacer frame indicated generally by reference numeral 75 which comprises a pair of parallel vertically spaced-apart wires 76 and 77 of equal length having wrap-around-ends wrapped around vertical supports 62 and 62', so as to maintain them in parallel spaced-apart relationship, but permitting swingable movement of each swing panel through an arc of substantially 360°, permitting the panels to be opened into a planar configuration lying coplanarly with the spacer frame 75 as illustrated schematically in FIG. 4, yet allowing the panels to be folded upon the spacer frame as shown in FIGS. 5 and 6, though it will be noted of course, that these Figs. are specific to the embodiment of the rack illustrated in FIG. 3.

The spacer frame 75 may be slidable on the vertical supports 62 and 62' without adversely affecting its function or strength. As illustrated in FIG. 1 and described hereinabove, a triangular keeper 78, analogous to keeper 43, having a horizontal forwardly protruding tab portion 79 is resistance welded to the spacer wires 76 and 77, to maintain their parallel configuration, to stiffen them, and to provide support for unopened bags stored on the rack.

A base 80 is provided by a thin sheet of metal, preferably steel less than 0.0625" thick, the side edges of which are tightly wrapped around horizontal portions 64 and 64', again avoiding welds in joints where strength is critical. As described before, the base is provided with through-apertures 54 to fasten the rack to a counter-top or other support structure with smooth round head screws 81. If unopened bags are stacked on keeper 78, there is little danger of articles loaded in the bag 20 from protruding through the rear of the rack, distending the bag, and being lodged against the spacer frame 75 when the bag is removed. If no bags are so stacked, it may be desirable to prevent objects from protruding from the rack, at the rear thereof, by providing a rear keeper-rail 82 with its ends resistance welded to the outer surfaces of the vertical supports 62 and 62', at any convenient location intermediate the base and the point where struts 65 and 65' are wrapped around the vertical supports. The rear keeper-rail also provides additional rigidity to the lower portion of the wire rack.

It will now be evident that, though the problem of the welds has been overcome in the construction of one preferred embodiment of my invention, the problem of wasted space in shipments of the racks, endures. It was solved in another preferred embodiment of my wire rack.

Referring now to FIG. 3, there is schematically illustrated another embodiment of the wire rack of my invention, indicated generally by reference numeral 90. The construction of the swing panels 91 and 91' is analogous to that of the swing panels 61 and 61', and the corresponding wire portions are similarly numbered with reference numerals as in FIG. 2. Instead of a pair of side keeper-raails 71 and 72 the panel 91 is provided with a single angularly disposed side keeper rail 83. A corresponding keeper-rail 83' is provided on panel 91'. No rear wire keeper rail is shown in FIG. 3, as it is unnecessary, but such keeper rail may be included if desired.

The spacer frame 75 permits the panels 91 and 91' to be swung into an open configuration coplanarly with the spacer frame, as illustrated in FIG. 4; and because swingable movement of the panels is essentially angularly unrestricted except by the spacer frame, the panels may also be folded over the frame as illustrated in FIGS. 5 and 6. Thus, the shipment of the wire frame may be effected in either of the three positions, all of which lend themselves to stacking of the racks, with a minimum waste of shipping space.

The base in this embodiment is provided by a laminar slab 92 made of an impact-resistant synthetic resinous material such as polypropylene, nylon, foamed high density polyethylene, or a polycarbonate thermosplastic based on bis-phenol A, in a thickness greater than the diameter of the wire stock from which the rack is made. For convenience, all wire used in the rack is of the same diameter, except for the keeper (43 or 78) which is of smaller diameter. Where for example, the wire stock is 0.25" dia., the base is preferably about 0.75" thick, and includes a rear wall portion 93 which is integrally molded. Along each side of the base 92 and wall 93 there is provided a continuous groove 94 in which the horizontal portion 64, and a portion of the vertical support 62, snugly fit. Threaded apertures are provided in the base (and, optionally the wall), in which machines screws, inserted through passages in the horizontal support 64, are threadedly received when the base is assembled to the remainder of the rack. Additionally, recessed through-apertures are provided in the base so that fastening means used to fasten the base to a support structure for the rack, are recessed below the surface of the base, and pose no threat to the integrity of the plastic film of the bag as it is loaded, or removed from the rack after it is loaded.

I claim:

1. A wire rack for holding a plastic bag open by its oppositely disposed integral handle loops, so that the bag may be loaded, said wire rack comprising, (a) left and right swing panels, each swing panel comprising a single piece of wire bent to provide
  (i) a vertical support,
  (ii) a tab-shaped horizontal upper portion to engage a handle loop of the bag,
  (iii) a horizontal lower portion,
  (iv) an upper angulated support strut portion having a wrap-around-end wrapped around the vertical support, and
  (v) a lower angulated support strut portion angulated relative to said horizontal lower portion at an angle greater than 45°, said angulated strut portion having a wrap-around-end wrapped around said upper angulated support strut;

(b) a spacer frame comprising plural parallel wire members each wire member having wrap-around left and right ends wrapped around the upper portion of each vertical support of said left and right swing panels respectively, so as to maintain the swing panels in vertically-spaced-apart mirror-image relationship with each other; and, (c) a laminar base support means connecting said horizontal lower portions of said swing panels to afford support for the bag.

2. The wire rack of claim 1 including a side keeper rail on each said swing panel to prevent articles loaded in said bag to distend it by protruding through said swing panel.

3. The wire rack of claim 2 wherein said laminar base support means includes a thin metal sheet the sides of which are tightly wrapped around said horizontal lower portions.

4. A collapsible wire rack for holding a plastic bag open by its oppositely disposed integral handle loops, so that the bag may be loaded, said wire rack comprising, (a) left and right swing panels, each swing panel comprising a single piece of wire bent to provide
  (i) a vertical support,
  (ii) a tab-shaped horizontal upper portion to engage a handle loop of the bag,
  (iii) a horizontal lower portion,
  (iv) an upper angulated support strut portion having a wrap-around-end wrapped around the vertical support, and
  (v) a lower angulated support strut portion angulated relative to said horizontal portion at an angle greater than 45°, said angulated strut portion having a wrap-around-end wrapped around said upper angulated support strut;

(b) a spacer frame comprising plural parallel wire members each wire member having wrap-around left and right ends wrapped around the upper portion of each vertical support of said left and right swing panels respectively, permitting swingable movement of each said panel in an arc of substantially 360° and maintaining said vertical supports of the swing panels in parallel-spaced-apart relationship with each other so as to permit the swing panels apnels to be folded upon said spacer frame; and, (c) a laminar base support means connected removably to said horizontal lower portions of said swing panels to afford support for the bag.

5. The wire rack of claim 4 including side keeper rails on each said swing panel to prevent articles loaded in said bag to distend it by protruding through said swing panel.

6. The wire rack of claim 4 wherein said laminar base support means includes a laminar slab of impact-resistant synthetic resinous material having a rear wall portion integral therewith, grooves in the sides of said slab to snugly accomodate said horizontal lower portions, and fastening means to removably fasten said horizontal lower portions to said slab.

* * * * *